US006176464B1

(12) United States Patent
Harvey

(10) Patent No.: US 6,176,464 B1
(45) Date of Patent: Jan. 23, 2001

(54) SNOWMAN MOLD

(76) Inventor: Martha A. Harvey, 410 Gonowabie Rd. P.O. Box 1452, Crystal Bay, NV (US) 89402

( * ) Notice: Under 35 U.S.C. 154(b), the term of this patent shall be extended for 0 days.

(21) Appl. No.: 09/222,533

(22) Filed: Dec. 29, 1998

(51) Int. Cl.[7] ..... B29C 33/26

(52) U.S. Cl. ..... 249/126; 249/163; 249/165; 249/170

(58) Field of Search ..... 249/117, 126, 249/156, 160, 163, 165, 167, 170; D15/136; 264/299, 334

(56) References Cited

U.S. PATENT DOCUMENTS

| | | | | |
|---|---|---|---|---|
| D. 315,001 | | 2/1991 | Bennett . | |
| D. 375,964 | | 11/1996 | Poubouridis . | |
| D. 382,317 | | 8/1997 | Huston . | |
| D. 384,960 | | 10/1997 | Kistler . | |
| 2,939,299 | * | 6/1960 | Sherbloom | 249/165 |
| 3,841,019 | | 10/1974 | Lorenzo . | |
| 4,164,341 | | 8/1979 | McComb . | |
| 4,322,004 | | 3/1982 | Schwuchow . | |
| 5,255,888 | * | 10/1993 | Workman | 249/165 |
| 5,380,237 | | 1/1995 | Kenyon . | |
| 5,632,926 | | 5/1997 | Dyer, Jr. . | |
| 5,851,415 | * | 12/1998 | Thomas | 249/170 |

* cited by examiner

*Primary Examiner*—James P. Mackey
(74) *Attorney, Agent, or Firm*—Dale J. Ream

(57) ABSTRACT

A snowman mold having a base member and a torso member defining interior spaces for receiving snow therein. The mold members include annular flanges extending radially outwardly from the members in a configuration that allows the torso member to be stacked upon and releasably secured to the base member prior to filling with snow. While the base and torso members have a substantially similar configuration, the torso member presents a circumference dimension that is smaller than the circumference dimension of the base member such that the torso member fits within the base member in a storage configuration. A snowman is constructed using the present invention by placing the base member on a surface, stacking and securing successively smaller mold members thereon, and depositing snow into the opening in the uppermost member. When the mold is completely filled, the members may be successively removed by opening the doors of each member and releasing the fasteners coupling the members together.

8 Claims, 7 Drawing Sheets

Section 6-6

SNOWMAN MOLD

BACKGROUND OF THE INVENTION

The present invention relates generally to a mold structure and, more particularly, to a snowman mold having stackable members which can be securely arranged and filled with snow to define a snowman shape.

A snowman is typically constructed by rolling snow into balls of various sizes and then stacking the balls on top of one another. Constructing a large or well-formed snowman is difficult for children because of the strength and coordination required to form, lift, and stack the awkward balls of snow.

Several structures for molding a snowman have been proposed in the prior art. These structures allow snow to be deposited therein with the structure being removable to reveal a snowman shape. Although assumably effective in operation, these molds either do not produce a well-formed snowman or are difficult for a child to safely manipulate.

It is therefore desirable to have a snowman mold which can better form completely symmetrical balls of snow. It is further desirable to have a mold which allows a plurality of mold members to be easily stacked and secured together prior to filling for easier construction and safety.

SUMMARY OF THE INVENTION

A preferred embodiment of the snowman mold according to the present invention includes a base member, a torso member, and a head member for efficiently, easily, and safely forming a snowman. Each member defines an interior space with upper and lower openings in communication therewith. Each member further includes annular flanges attached to the members adjacent one or both openings and which extend radially outwardly from the members. The outward configuration of the flanges facilitates the complete filling of the members as well as allowing the members to be stacked on one another prior to depositing snow therein. The flanges further include fasteners for releasably coupling the members together.

Each member presents a substantially similar spherical configuration. The base member, however, has a larger circumference than the torso member which, in turn, has a larger circumference than the head member. Each member further includes a pair of pivotally coupled semi-spherical doors which can be opened for receiving a smaller sized member therein.

The mold members are particularly well-suited for allowing children to safely construct a properly shaped snowman. The base member is placed on a surface at the desired location for the snowman. The torso member is then stacked on the base member with the outwardly extending flanges bearing against one another. The fasteners are then inserted through the flanges to couple the torso member to the base member. A head member can be stacked and secured to the torso member in like manner. Snow is then deposited through the upper opening of the head member and is communicated through each member until all members are filled. The doors of each mold member are then opened to reveal the now formed snowman and the members are removed from one another in the reverse order as they were stacked.

It is therefore a general object of the invention to provide a mold for forming a snowman shaped figure of snow.

Another object of the invention is to provide a mold, as aforesaid, having a plurality of members which can be easily stacked one upon another during construction of a snowman.

Still another object of the invention is to provide a mold, as aforesaid, which can securely hold the plurality of members together during construction of a snowman.

A further object of the invention is to provide a mold, as aforesaid, which can be filled to form fully symmetrical balls of snow.

A still further object of the invention is to provide a mold, as aforesaid, wherein the plurality of members can be concentrically stored one within another when not in use.

Yet another object of the invention is to provide a mold, as aforesaid, wherein each mold member includes hinged doors which allow the mold member to be removed to reveal the completed snowman.

A further object of the invention is to provide a mold, as aforesaid, which includes a kit of accessories for decorating the resulting snowman.

Other objects and advantages of this invention will become apparent from the following description taken in connection with the accompanying drawings, wherein is set forth by way of illustration and example, an embodiment of this invention.

BRIEF DESCRIPTIONS OF THE DRAWINGS

DESCRIPTION OF THE PREFERRED EMBODIMENT

Figure 1:
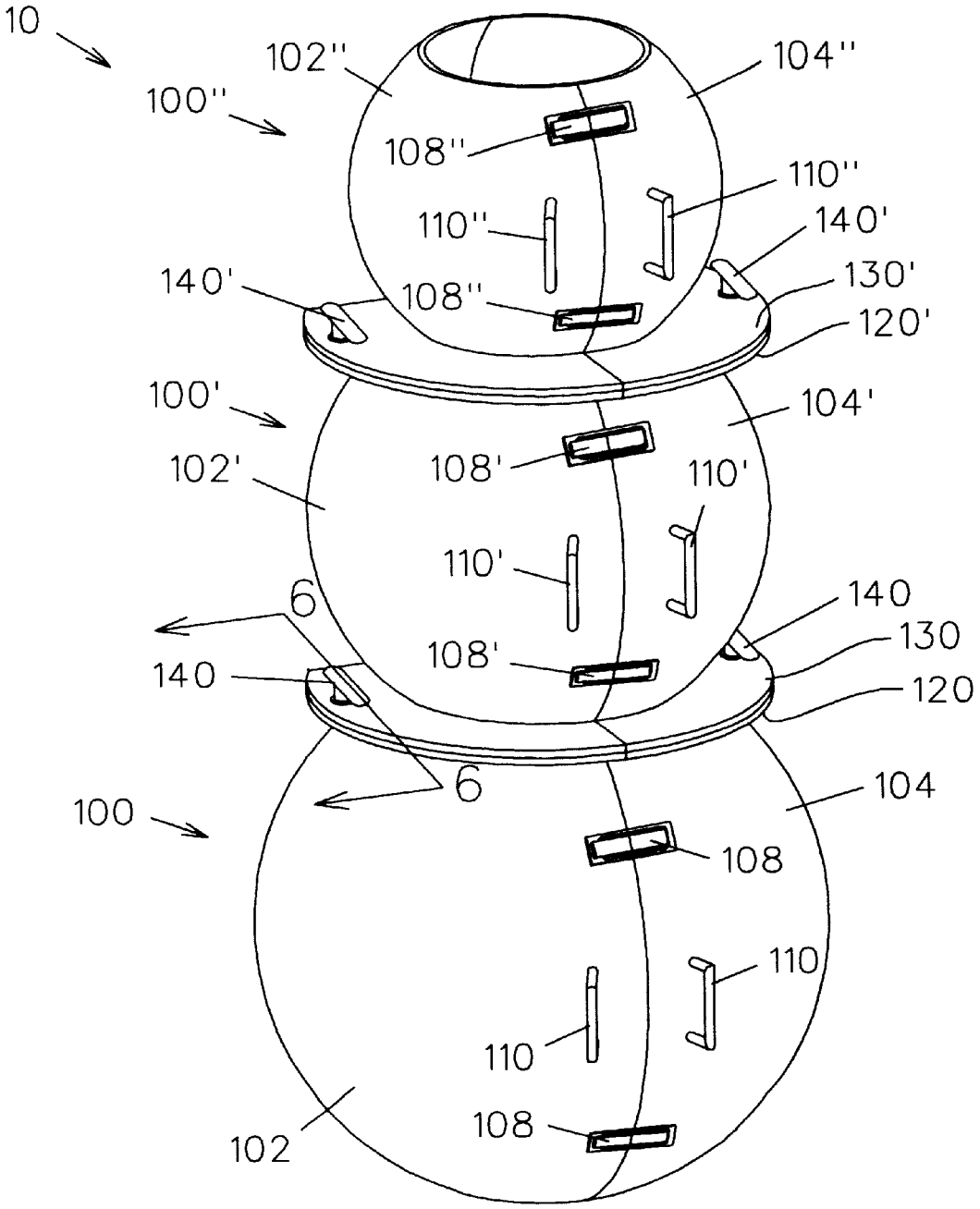
FIG. 1 is a perspective view in accordance with the preferred embodiment of the present invention showing the snowman mold with the mold members stacked and secured together in a closed configuration.
Figure 2A:
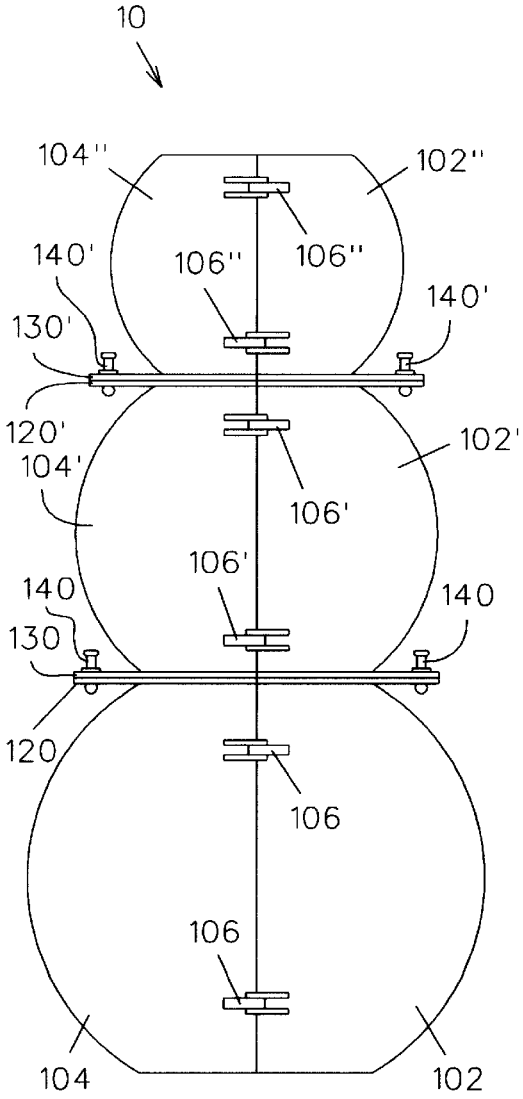
FIG. 2A is a rear view of the snowman mold of FIG. 1.
Figure 2B:
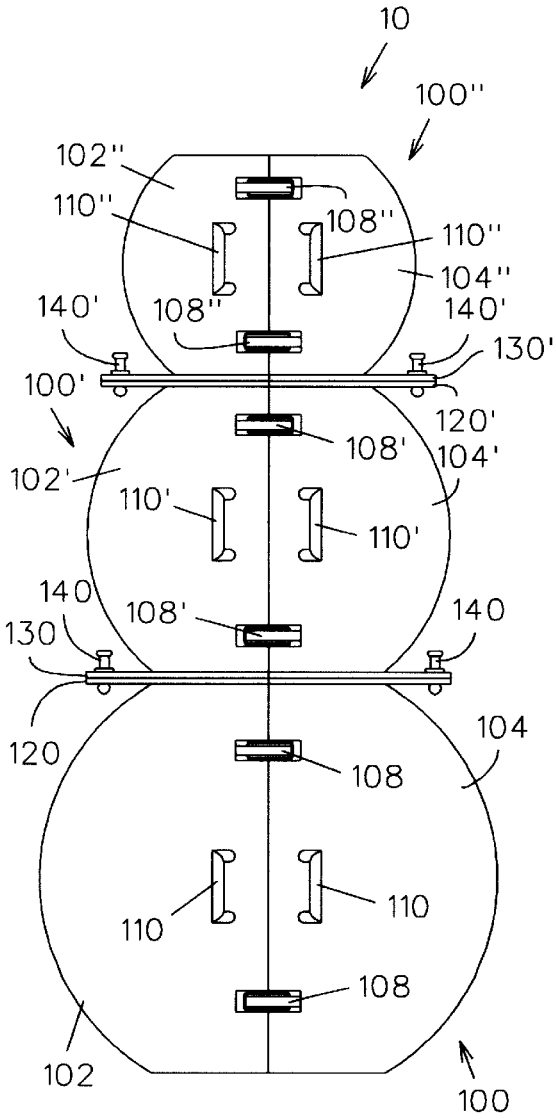
FIG. 2B is a front view of the snowman mold of FIG. 1.
Figure 3:
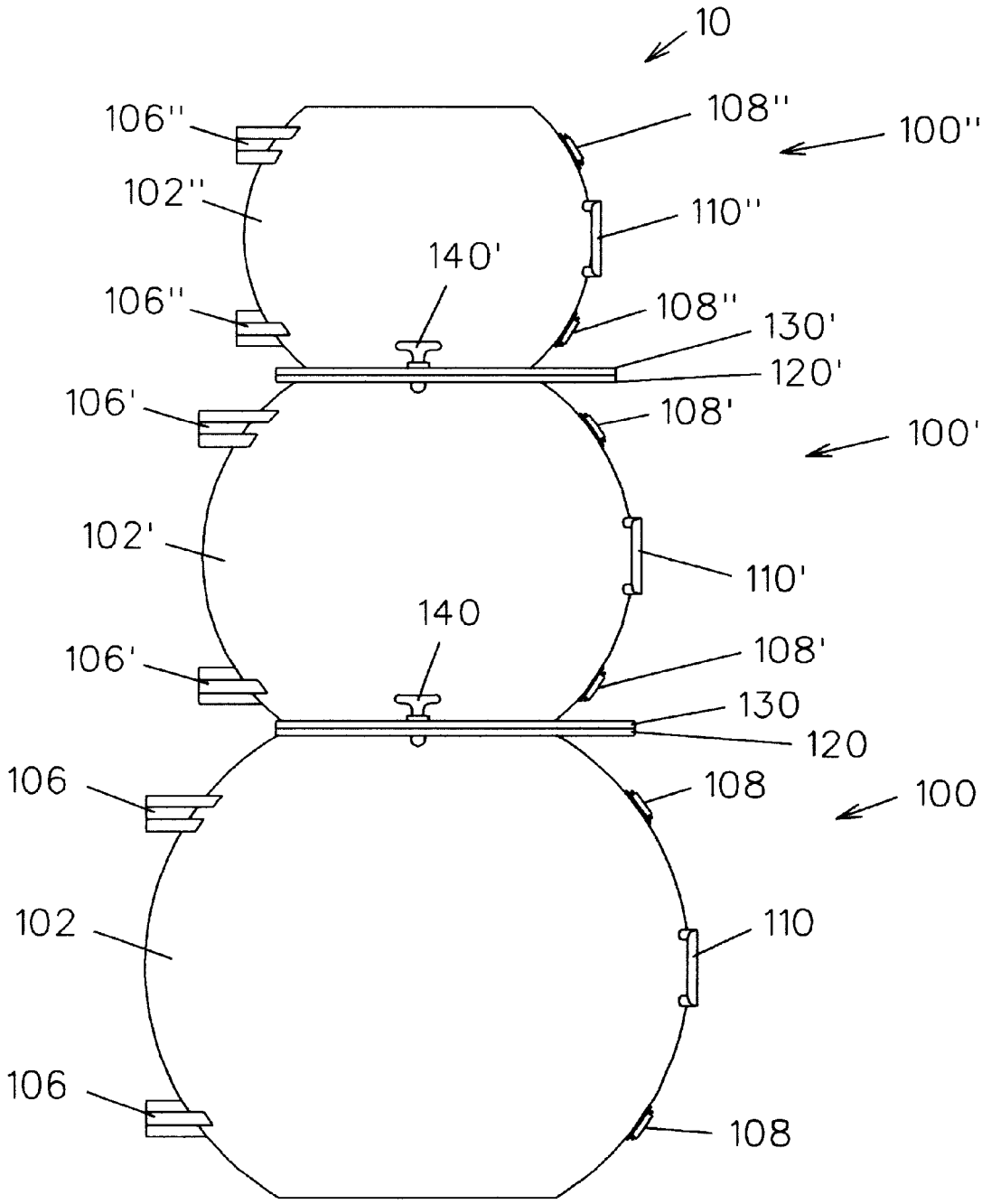
FIG. 3 is a left side view of the snowman mold of FIG. 1.

The preferred embodiment of a snowman mold 10 according to the present invention is shown in FIG. 1 and includes a base member 100, a torso member 100', and a head member 10041 , each member being constructed of a rigid plastic material although other suitable materials could be used.

Figure 4A:
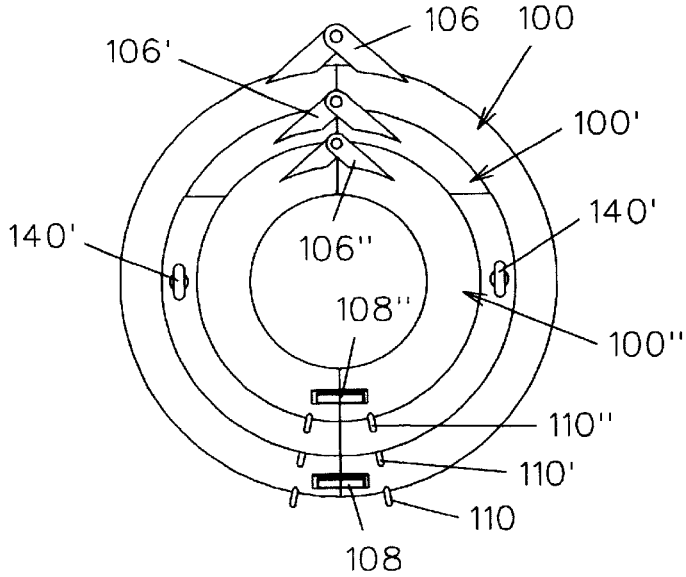
FIG. 4A is a plan view of the snowman mold of FIG. 1.
Figure 4B:
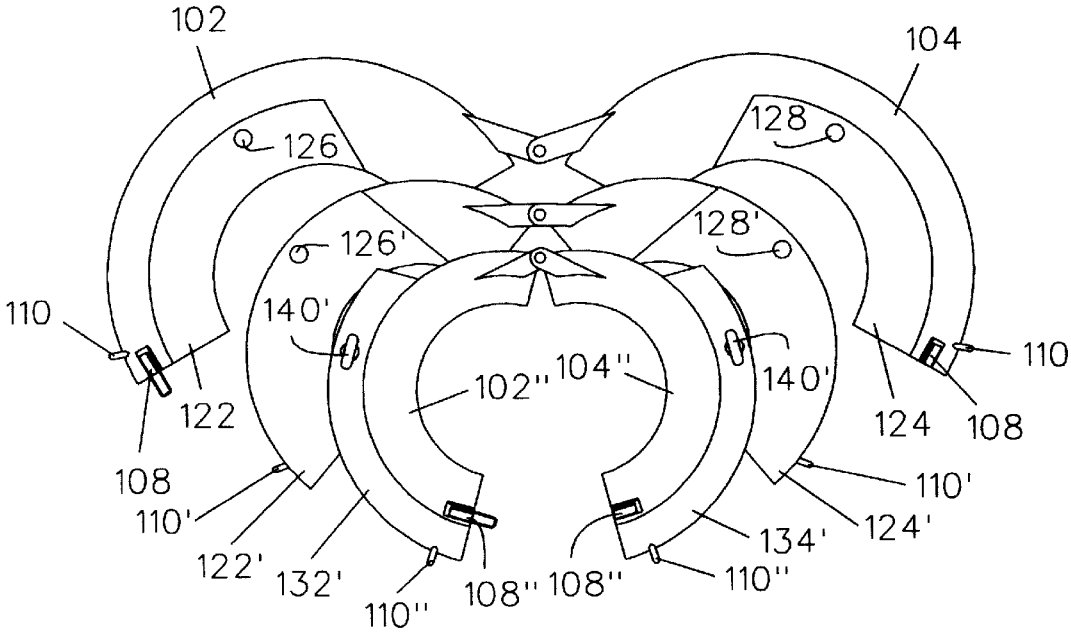
FIG. 4B is a plan view of the snowman mold with the mold members in an opened configuration.

The base member 100 comprises first 102 and second 104 spherical portions configured about an imaginary longitudinal axis for defining a hollow interior space with upper and lower openings in communication therewith. The first 102 and second 104 portions are pivotally coupled at rear edges thereof by a pair of hinges 106. Front edges of the first 102 and second 104 portions are releasably coupled by a pair of latches 108 or clasps or other suitable fasteners. Handles 110 are fixedly attached to the first 102 and second 104 portions adjacent front edges thereof for selectively pivoting the portions about the hinges 106 between an open and closed configuration (FIGS. 4A and 4B).

An annular flange 120 is fixedly attached to the base member 100 adjacent to the upper opening therein. The base flange 120 extends radially outwardly from the base member 100 for stacking the torso member 100' thereon as to be further described later. It should also be appreciated that the outward flange configuration allows the interior space of the base member to be completely filled with snow or other ballast.

Figure 5:
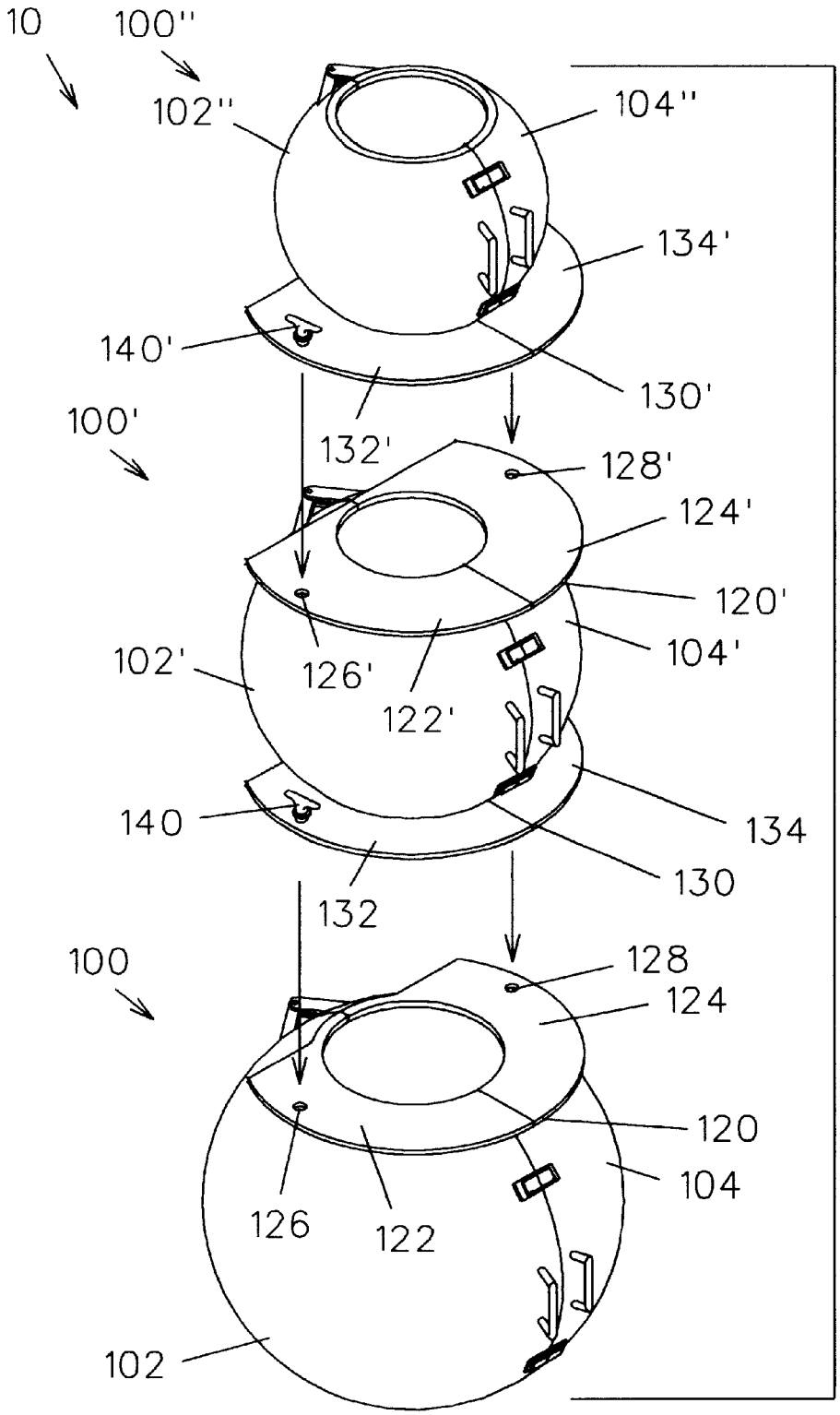
FIG. 5 is an exploded view of the snowman mold of FIG. 1.

As more particularly shown in FIG. 5, the base flange 120 comprises a first flange portion 122 fixedly attached to the first base portion 102 and a second flange portion 124 fixedly attached to the second base portion 104. Thus, the base flange 120 is movable between an open and closed configuration according to the pivotal movement of the first 102 and second 104 base portions. Base flange portions 122, 124 define circular aperture 126, 128 for receiving fasteners 140 therethrough as to be described below.

The snowman mold 10 further includes a torso member 100' having a construction substantially similar to that of the base member 100 described above, primed numbers being used in the illustrations to identify like structures, except as specifically described below. A first annular torso flange 130 is fixedly attached to the torso member 100' adjacent to the lower opening therein. The first torso flange 130 extends radially outwardly from the torso member and is configured for stacking the torso member 100' on the base member 100. The first torso flange 130 further comprises a first flange portion 132 fixedly attached to the first torso portion 102' and a second flange portion 134 fixedly attached to the second torso portion 104' such that the first torso flange 130 is movable between an open and closed configuration according to the pivotal movement of the torso portions 102', 104'.

Figure 6A:
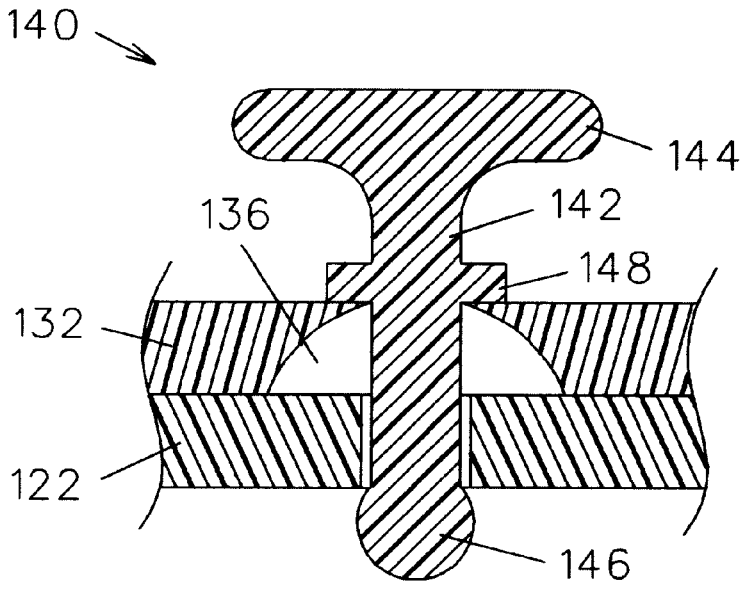
FIG. 6A is a sectional view of a locking assembly in a locked configuration taken along lines 6—6 of FIG. 1.
Figure 6B:
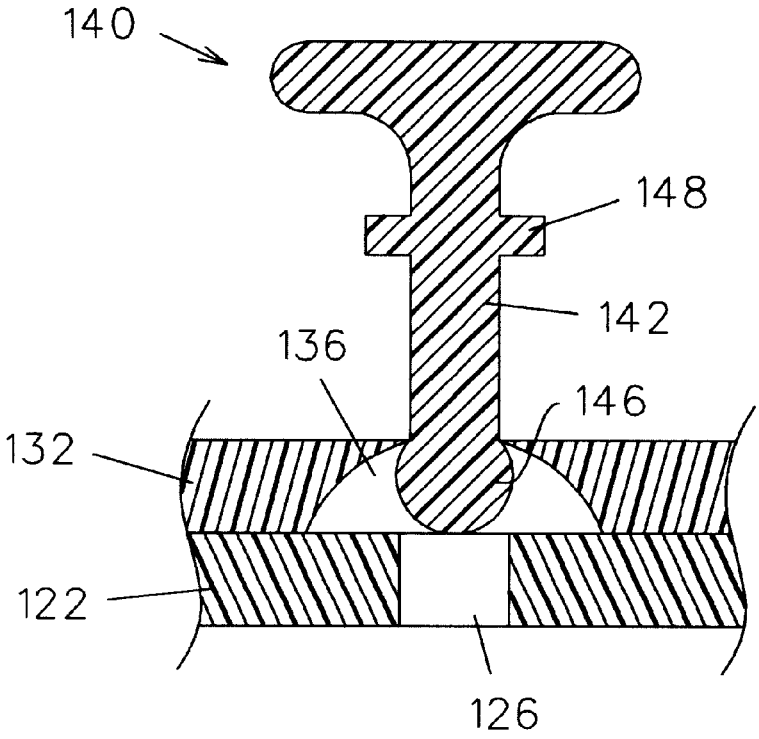
FIG. 6B is a view of the locking assembly of FIG. 6A in an unlocked configuration.
Figure 7:
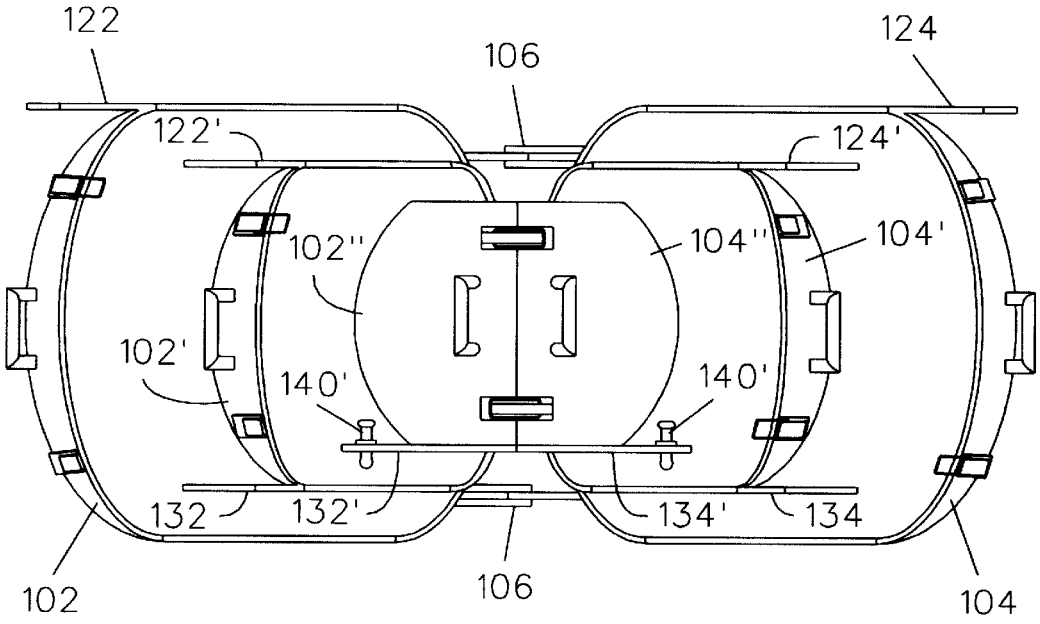
FIG. 7 is a front view of the snowman mold showing the mold members in a storage configuration.

Each first torso flange portion 132, 134 defines an aperture which communicates with a cavity 136 defined in the lower surface of each flange portion 132, 134 (FIGS. 6A and 6B). The cavities 136 of the first torso flange portions 132, 134 register with the apertures 126, 128 of the base flange 120 when the torso member 100' is stacked upon the base member 100 such that a fastener 140 can be extended therethrough for snappably coupling the torso member 100' to the base member 100. The fastener 140 includes a shaft 142 having a handle member 144 integrally attached to the upper end thereof and having an opposing bulbous end 146. The fastener 140 is selectively movable between a non-coupled configuration in which the bulbous end 146 is held within the cavity 136 and a coupled configuration in which the bulbous end 146 is snappably extended through an aperture 126 of the base flange 120. Each fastener 140 further includes an arm 148 normal to the shaft 142 and adjacent to the handle member 144 for regulating the downward extension of the fastener 140.

A second annular torso flange 120' is fixedly attached to the torso member 100' adjacent to the upper opening therein. The configuration of the second torso flange 120' is substantially similar to that of the base flange 120 and is illustrated with corresponding primed numbers.

While the base 100 and torso 100' members have a substantially similar configuration, the torso member 100' presents a circumference that is smaller than the circumference of the base member 100 such that the torso member can be housed within the interior space of the base member 100. This storage of the torso member 100' is effected by first releasing the latches 108 which couple the base portions 102, 104 and then pivoting the portions 102, 104 to an open configuration. The torso member 100' can then be placed within the interior space of the base member 100 and the base portions 102, 104 can be returned to a closed configuration.

The snowman mold 10 further includes a head member 100" having a construction substantially similar to the torso member 100', doubly primed numbers being used to identify like structures, except as specifically described below. An annular head flange 130' is fixedly attached to the head member 100" adjacent to the lower opening therein. The configuration of the head flange 130' is substantially similar to the first torso flange 130 and is thus referenced in the illustrations with appropriately primed numbers. The head flange 130' can be fastened to the second torso flange 120' in the same manner as the first torso flange 130 is coupled to the base flange 120, as previously described.

While the head 100" and torso 100' members have a substantially similar configuration, the head member 100" presents a circumference that is smaller than the circumference of the torso member 100' such that the head member 100" can be housed within the interior space of the torso member 100' in the manner previously described.

In operation, the base member 100, torso member 100', and head member 100" are each secured by latches 108 in a closed configuration. The base member 100 is then placed on a surface at the desired location for constructing a snowman. The torso member 100' is then stacked on the base member with the first torso flange 130 bearing against the base flange 120. The torso member 100' is coupled to the base member 100 by snappably extending fasteners 140 through the flanges 120, 130. A head member 100" can be stacked and secured to the torso member 100' in like manner.

Snow or other ballast is then deposited through the upper opening in the head member 100" and is communicated through each member until all members are filled therewith. The latches 108 holding each pivotal portion are released and the portions are pivoted to an open configuration to reveal the now formed snowman. Finally, the fasteners coupling the members are snappably released and the members are unstacked.

Storage of the head 100", torso 100', and base 100 members is effected by first releasing latches 108' and opening the pivotal portions 102', 104' of the torso member 100'. The head member 100", having a circumference smaller than the circumference of the torso member 100', is then inserted therein and the latches 108' are refastened. The latches 108 on the base member 100 are then released and the pivotal portions 102, 104 are opened. The torso member 100', having a circumference smaller than the circumference of the base member 100, is then placed within the base member 100 and the latches 108 are refastened.

It is understood that while certain forms of this invention have been illustrated and described, it is not limited thereto except insofar as such limitations are included in the following claims and allowable functional equivalents thereof.

What is claimed is:

1. A snowman mold, comprising:

a base member defining an interior space and an upper opening in communication with the interior space, and including an annular base flange attached to the base member adjacent to the upper opening, the base flange extending radially outwardly from the base member;

a torso member defining an interior space and a lower opening and an upper opening in communication with the interior space, and including a first annular torso flange attached to the torso member adjacent the lower opening and extending radially outwardly from the torso member, the first torso flange being engaged with the base flange for stacking the torso member on the base member, the torso member further including a second annular torso flange attached to the torso member adjacent the upper torso opening and extending radially outwardly from the torso member;

an aperture defined through the base flange;

an aperture defined through the first torso flange and positioned to register with the base flange aperture;

a fastener adapted to extend through the base flange aperture and through the first torso flange aperture for releasably coupling the torso member to the base member;

wherein the base member includes a first spherical base portion and a second spherical base portion pivotally coupled to the first base portion for movement of the base member between an open and a closed configuration, the first base portion being releasably coupled to the second base portion with a latch for selectably holding the base member in the closed configuration;

wherein the base flange includes a first flange portion attached to the first base portion and a second flange portion attached to the second base portion;

wherein the torso member includes a first spherical torso portion and a second spherical torso portion pivotally coupled to the first torso portion for movement of the torso member between an open and a closed configuration, the first torso portion being releasably coupled to the second torso portion with a latch for holding the torso member in the closed configuration;

wherein the first torso flange includes a first flange portion attached to the first torso portion adjacent the lower torso opening and a second flange portion attached to the second torso portion adjacent the lower torso opening;

wherein the second torso flange includes a first flange portion attached to the first torso portion adjacent the upper torso opening and a second flange portion attached to the second torso portion adjacent the upper torso opening.

2. The snowman mold as in claim 1, further including:

a head member defining an interior space and a lower opening in communication with the interior space, and including an annular head flange attached to the head member adjacent the lower opening and extending radially outwardly from the head member, the head flange being configured for engagement with the second torso flange for stacking the head member on the torso member.

3. A snowman mold as in claim 2, further including:

an aperture defined through the second torso flange;

an aperture defined through the head flange and positioned to register with the second torso flange aperture; and a fastener adapted to extend through the second torso flange aperture and through the head flange aperture for releasably coupling the torso member to the head member.

4. A snowman mold as in claim 1 wherein the fastener includes a shaft having a first end and a second opposed end, the first end presenting a handle, the second end being adapted to releasably couple the torso member to the base member.

5. The snowman mold as in claim 2 wherein:

the head member includes a first spherical head portion and a second spherical head portion pivotally coupled to the first head portion for movement of the head member between open and closed configurations; and the head flange includes a first flange portion attached to the first head portion adjacent the lower head opening and a second flange portion attached to the second head portion adjacent the lower head opening.

6. The snowman mold as in claim 5 wherein the first head portion is releasably coupled to the second head portion with a latch for holding the head member in a closed configuration.

7. A snowman mold as in claim 5, wherein:

the base member presents a circumference dimension; and the torso member presents a circumference dimension smaller than the circumference dimension of the base member so that the torso member fits within the interior space of the base member in a storage configuration.

8. A snowman mold as in claim 7, wherein the head member presents a circumference smaller than the circumference of the torso member so that the head member fits within the interior space of the torso member in a storage configuration.

* * * * *